US005227285A

United States Patent [19]

Hattori et al.

[11] Patent Number: 5,227,285

[45] Date of Patent: Jul. 13, 1993

[54] SILVER HALIDE PHOTOGRAPHIC MATERIAL

[75] Inventors: Yasushi Hattori; Akira Hatakeyama, both of Kanagawa, Japan

[73] Assignee: Fuji Photo Film Co., Ltd., Kanagawa, Japan

[21] Appl. No.: 955,070

[22] Filed: Oct. 1, 1992

[30] Foreign Application Priority Data

Oct. 2, 1991 [JP] Japan ..... 3-255568

[51] Int. Cl.[5] ..... G03C 1/76

[52] U.S. Cl. ..... 430/534; 430/510; 430/513; 430/523; 430/531; 430/539; 430/930

[58] Field of Search ..... 430/523, 531, 534, 535, 430/536, 930, 510, 513

[56] References Cited

U.S. PATENT DOCUMENTS

| | | | |
|---|---|---|---|
| 3,627,533 | 12/1971 | Jacoby et al. | 430/523 |
| 4,582,784 | 4/1986 | Fukugawa et al. | 430/523 |
| 4,585,730 | 4/1986 | Cho et al. | 430/523 |
| 4,990,434 | 2/1991 | Van Thillo et al. | 430/523 |
| 5,077,185 | 12/1991 | Cho et al. | 430/523 |
| 5,124,242 | 6/1992 | Hattori et al. | 430/510 |

*Primary Examiner*—Jack P. Brammer
*Attorney, Agent, or Firm*—Sughrue, Mion, Zinn, Macpeak & Seas

[57] ABSTRACT

A silver halide photographic element is described, including a support having on one surface thereof (A) a subbing layer composed of (1) at least one non-hydrophilic polymer layer and (2) a hydrophilic colloid layer containing a dye dispersed therein in a solid state, wherein the hydrophilic colloid layer is coated on the non-hydrophilic polymer layer, and (B) at least one silver halide emulsion layer having a hydrophilic colloid as a binder, wherein the at least one silver halide emulsion layer is formed on the subbing layer, and having on the surface of the support opposite to the side having the silver halide emulsion layer (C) a light-insensitive hydrophilic colloid layer having a hydrophilic colloid as a binder, wherein the silver halide photographic material has a hydrophobic polymer layer which is positioned on the side of the support having the light-insensitive hydrophilic colloid layer and which is located further from the support than the light-insensitive hydrophilic colloid layer, and wherein the light-insensitive hydrophilic colloid layer and the hydrophobic polymer layer do not swell substantially when processed with a processing solution.

20 Claims, No Drawings

SILVER HALIDE PHOTOGRAPHIC MATERIAL

FIELD OF THE INVENTION

The present invention relates to a silver halide photographic material, and more particularly to a silver halide photographic material showing an improved drying property and an improved sharpness after processing.

BACKGROUND OF THE INVENTION

Recently, a shortened photographic processing time for silver halide photographic material has been required.

For shortening the photographic processing time, a means of improving the drying property of silver halide photographic material to shorten the drying time is effective.

As a means for improving the drying property of silver halide photographic material after processing, a method of reducing the amount of the binder in the silver halide photographic material has been used, but the method is accompanied by problems such as a lowering of the mechanical strength of the silver halide photographic material, the formation of scratch blackening, and the occurrence of roller marks.

The scratch blackening is the phenomenon that when the surface of a silver halide photographic film is scraped while handling the silver halide photographic film before processing, the scraped portion is blackened in a scratch form after processing.

Also, the roller mark is the phenomenon that in the case of processing a silver halide photographic material with an automatic processor, pressure is applied to the silver halide photographic material by the fine uneven portions of rollers of the automatic processor to form black speck-like density unevenness.

Both the scratch blackening and the roller marks greatly reduce the commercial value of the silver halide photographic materials.

As another means for improving the drying property, it is also effective to increase the amount of hardening agent being added to a silver halide photographic material.

In this method, swelling of the silver halide photographic material at processing is decreased, and the drying property of the photographic material is thereby improved.

However, this method is accompanied by problems such as a lowering of the sensitivity by delaying development, and a lowering of the covering power, the formation of residual silver, residual color, etc., by delaying fixing, and hence a satisfactory improvement of the drying property cannot be obtained by the foregoing method.

In the case of a silver halide photographic material having at least one silver halide emulsion layer on one side of the support (hereinafter referred to as one-side light-sensitive material), by removing a light-insensitive hydrophilic colloid layer from the back surface or by using a hydrophobic binder as the binder of a light-insensitive layer of the back layer, the drying property can be improved.

However, by the foregoing method, the silver halide photographic material becomes too curled to be practically used.

Also, more improvement of the image quality of a silver halide photographic material has been demanded.

In particular, in a photographic light-sensitive material for making a printing plate, a dot to dot work stage is required to be repeated many times, and hence if the light-sensitive material does not have a sufficient resolving power, the images formed become more and more blurred with the repetition of each dot to dot work stage. Thus, a higher image quality has been desired in such a plate-making photographic light-sensitive material.

In a microphotographic light-sensitive material, photographic images formed are not directly viewed, but rather the magnified images are viewed, and hence a higher image quality has been required from the necessity that the photographic images may be legal evidence.

For highly improving the image quality of a photographic light-sensitive material, a photographic emulsion layer or other layer has been colored to absorb light having a specific wavelength. Also, a colored layer has been formed between a photographic emulsion layer and a support or on the surface of a support opposite to a photographic emulsion layer side for preventing the occurrence of blurring of photographic images, that is, for preventing the occurrence of halation caused by that light scattered during or after the passing of incident light through a photographic emulsion layer or, being reflected at the interface between the photographic emulsion layer and the support or at the surface of the light-sensitive material opposite to the emulsion layer side, and entering the photographic emulsion layer again. Such a colored layer is called an antihalation layer (AH layer).

The layer being colored is frequently composed of a hydrophilic colloid, and a dye is usually incorporated in the layer for coloring the layer. The dye being used for this purpose is required to satisfy the following conditions.

(1) The dye has a proper spectral absorption according to the purpose of use.

(2) The dye is photochemically inactive. That is, the dye does not have a bad chemical influence (such as lowering the sensitivity, latent image fading, and fogging) on the performance of a silver halide photographic emulsion layer.

(3) The dye is decolored or dissolved off in the photographic processing step to avoid the formation of residual color on the photographic light-sensitive material after processing.

As a method of forming the dyed layer, a method of dissolving a soluble dye in a coating composition for forming the hydrophilic colloid layer has been used. Such a method is disclosed in British Patents 1,414,456, 1,477,638 and 1,477,639.

The foregoing method has the fault that if it is attempted to prevent the occurrence of the residual color by increasing the water-solubility of a dye, the fixing degree of the dye is reduced, and the dye thereby diffuses into the adjacent layer to cause desensitization and the transfer of the dye to other photographic light-sensitive material.

Also, a method of incorporating a dissociated anionic dye in a layer of a photographic light-sensitive material together with a hydrophilic polymer having the opposite charge to that of the anionic dye as a mordant and localizing the dye in the specific layer by the interaction of the dye molecule and the polymer is disclosed in U.S. Pat. Nos. 2,548,564, 4,124,386, and 3,625,694. However, when, in the foregoing method, anionic material other than the anionic dye exists in the same layer, undesirable problems occur for production aptitude that the dye is not localized well, the coating composition is aggregated, etc.

As a method of overcoming these troubles, a method of providing a dye dispersed in a fine crystal state between a support and a silver halide emulsion layer of a photographic light-sensitive material is disclosed in U.S. Pat. No. 4,803,150 and WO 88/04794. The method is an excellent technique for increasing the image quality without being accompanied by desensitization.

However, the foregoing technique mainly has problems in the aptitude for quick processing of less than 60 seconds, which has recently been demanded, and in the aptitude for the production of the photographic light-sensitive material.

The problem in quick processing is as follows. That is, when a new layer is formed as an AH layer, the amount of the total hydrophilic colloid is increased, since an AH layer is usually composed of a hydrophilic colloid. If the amount of a hydrophilic colloid is increased, the amount of water absorbed in a photographic light-sensitive material in processing steps is increased, thereby deteriorating the drying property of the light-sensitive material, which is a fatal problem in quick processing of less than 60 seconds.

SUMMARY OF THE INVENTION

One object of the present invention is to provide a silver halide photographic material having a good drying property after photographic processing.

A second object of the present invention is to provide a silver halide photographic material which does not have a significant curling problem.

A third object of the present invention is to provide a silver halide photographic material having an improved sharpness.

It has now been discovered that the foregoing objects can be attained by the present invention described hereinbelow.

That is, according to the present invention, there is provided a silver halide photographic element comprising a support having on one surface thereof (A) a subbing layer composed of (1) at least one non-hydrophilic polymer layer and (2) a hydrophilic colloid layer containing a dye dispersed therein in a solid state, wherein the hydrophilic colloid layer is coated on the non-hydrophilic polymer layer, and (B) at least one silver halide emulsion layer having a hydrophilic colloid as a binder, wherein the at least one silver halide emulsion layer is formed on the subbing layer, and having on the surface of the support opposite to the side having the silver halide emulsion layer (C) a light-insensitive hydrophilic colloid layer having a hydrophilic colloid as a binder, wherein the silver halide photographic material has a hydrophobic polymer layer which is positioned on the side of the support having the light-insensitive hydrophilic colloid layer and which is located further from the support than the light-insensitive hydrophilic colloid layer, and wherein the light-insensitive hydrophilic colloid layer and the hydrophobic polymer layer do not swell substantially when processed with a processing solution.

DETAILED DESCRIPTION OF THE INVENTION

The present invention is described in detail below.

First, the light-insensitive hydrophilic colloid layer (hereinafter referred to as a back layer) and the hydrophobic polymer layer formed on the back layer are explained.

The back layer in the present invention is a layer having a hydrophilic colloid as a binder, and as the hydrophilic colloid being used for the back layer, is preferred a hydrophilic binder having a similar hygroscopicity and hygroscopic rate to the binder for the photographic layers on the side having the silver halide emulsion layer from the viewpoint of inhibiting the occurrence of curling. The hydrophilic colloid being used as the binder for the back layer in the present invention is most preferably gelatin.

As the gelatin, any gelatin which is generally used in the field of the art, such as lime-processed gelatin, acid-processed gelatin, enzyme-processed gelatin, gelatin derivatives, denatured gelatin, etc., can be used.

Among these gelatins, lime-processed gelatin and acid-processed gelatin are most preferably used.

Hydrophilic colloids other than gelatin can also be used in this invention as the binder. As such hydrophilic colloids, proteins such as colloidal albumin, casein, etc.; saccharose derivatives such as agar agar, sodium alginate, starch derivatives, etc.; cellulose compounds such as carboxymethyl cellulose, hydroxymethyl cellulose, etc.; and synthetic hydrophilic compounds such as polyvinyl alcohol, poly-N-vinyl pyrrolidone, polyacrylamide, etc., can be used.

In the case of using a synthetic hydrophilic compound, the compound may be copolymerized with other components such as a hydrophobic copolymerizable component, but in this case, if the proportion of a hydrophobic copolymerizable component is too large, the hygroscopicity and the hygroscopic rate of the back layer become less, and hence such an embodiment is disadvantageous from the viewpoint of inhibiting the occurrence of curling.

These hydrophilic colloids may be used singly or as a mixture thereof.

The back layer in the present invention may further contain photographic additives such as a matting agent, a surface active agent, a dye, a crosslinking agent, a thickener, an antiseptic, a UV absorbent, inorganic fine particles (e.g., colloidal silica, etc.), etc., in addition to the binder.

These additives are described, e.g., in *Research Disclosure*, Vol. 176, No. 17643 (December, 1978).

The back layer in this invention may further contain a polymer latex.

The polymer latex which is used in this invention is an aqueous dispersion of a water-insoluble polymer having an average particle size of from 20 μm to 200 μm, and the amount of the polymer latex which is used is preferably from 0.01 to 1.0, and particularly preferably from 0.1 to 0.8 by dry weight ratio to 1.0 of the binder.

A preferred example of the polymer latex for use in this invention is a polymer having an average molecular weight of at least 100,000, and particularly preferably from 300,000 to 500,000, and having the alkyl ester, the hydroxyalkyl ester or the glycidyl ester of acrylic acid; or the alkyl ester, the hydroxyalkyl ester, or the glycidyl ester of methacrylic acid as the monomer unit.

Practical examples thereof are shown by the following formulae:

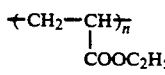
Polymer-1

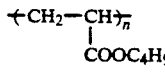
Polymer-2

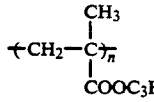
Polymer-3

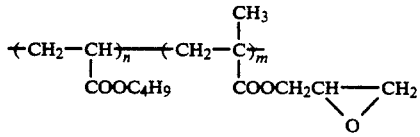
Polymer-4

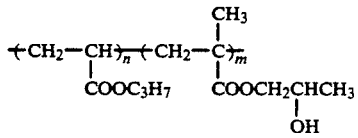
Polymer-5

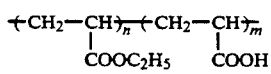
Polymer-6

The back layer in this invention may be composed of a single layer or two or more layers. Also, there is no particular restriction on the thickness of the back layer in the present invention, although the thickness thereof is preferably from about 0.2 μm to 20 μm, and particularly preferably from 0.5 μm to 10 μm from the viewpoint of inhibiting the occurrence of curling.

When the back layer in this invention is composed of two or more layers, the sum of the thicknesses of all of the layers is defined as the thickness of the back layer of the silver halide photographic material of the present invention.

The back layer in this invention does not swell substantially when processed with a processing solution. The term "does not swell substantially when processed with a processing solution" means that the thickness of the back layer after finishing washing in the photographic processing is less than 1.05 times the thickness of the back layer after finishing drying.

Since the back layer in this invention is composed of a hydrophilic colloid such as gelatin, etc., as the binder, the back layer can essentially swell with a processing solution.

However, in the present invention, the back layer becomes substantially non-swellable as a result of the existence of the hydrophobic polymer layer (hereinafter sometimes referred to as the polymer layer) formed on the foregoing back layer.

There is no particular restriction on the manner of forming the back layer in this invention.

That is, a conventionally known method of forming hydrophilic colloid layers for silver halide photographic materials can be used. For example, a dip coating method, an air knife coating method, a curtain coating method, a roller coating method, a wire bar coating method, a gravure coating method, an extrusion coating method using the hopper described in U.S. Pat. No. 2,681,294, and the multilayer simultaneous coating methods described in U.S. Pat. Nos. 2,761,418, 3,508,947, and 2,761,791 can be used.

The hydrophobic polymer layer (polymer layer) in the present invention is explained below.

The polymer layer in this invention does not swell substantially when processed with a processing solution. The term "does not swell substantially when processed with a processing solution" means that the thickness of the polymer layer after finishing washing in the photographic processing is less than 1.05 times the thickness of the polymer layer after finishing drying.

As the binder for the polymer layer in the present invention, any binders can be used without any restriction if the polymer layer and the back layer become "substantially unswellable with a processing solution".

Practical examples of the binder for the polymer layer are polyethylene, polypropylene, polystyrene, polyvinyl chloride, polyvinylidene chloride, polyacrylonitrile, polyvinyl acetate, a urethane resin, a urea resin, a melamine resin, a phenol resin, an epoxy resin, fluorine series resins (e.g., tetrafluoroethylene and polyvinylidene fluoride), rubbers (e.g., butadiene rubber, chloroprene rubber, and natural rubber), acrylic acid esters or methacrylic acid esters (e.g., polymethyl methacrylate and polyethyl acrylate), polyester resins (e.g., polyethylene phthalate), polyamide resins (e.g., nylon 6 and nylon 66), cellulose resins (e.g., cellulose triacetate), water-insoluble polymers (e.g., a silicone resin), and derivatives thereof.

Furthermore, the binder for the polymer layer may be a homopolymer composed of one kind of a monomer or a copolymer composed of two or more kinds of monomers.

The foregoing binders may be used singly or as a mixture thereof.

The polymer layer in this invention may, if necessary, contain photographic additives such as a matting agent, a surface active agent, a dye, a lubricant, a crosslinking agent, a thickener, a UV absorbent, inorganic fine particles (e.g., colloidal silica), etc.

These additives are also described in *Research Disclosure,* Vol. 176, No. 17643 (December, 1978).

The polymer layer in this invention may be composed of a single layer or two or more layers. Also, there is no particular restriction on the thickness of the polymer layer in this invention.

However, if the thickness of the polymer layer is too thin, the water resistance of the polymer layer becomes insufficient, and the back layer thereby becomes inadequately swellable with a processing solution. On the other hand, if the thickness of the polymer layer is too thick, the vapor permeability of the polymer layer becomes insufficient, and the moisture absorption and desorption of the hydrophilic colloid layer of the back layer are thereby hindered to cause curling. As a matter of course, the thickness of the polymer layer depends upon the property of the binder being used. Accordingly, it is necessary to determine the thickness of the polymer layer by considering both the cases. The thickness of the polymer layer is in the range of preferably from 0.05 μm to 10 μm, and more preferably from 0.1 μm to 5 μm, although the thickness depends upon the kind of the binder.

In addition, when the polymer layer in this invention is composed of two or more layers, the sum of the thicknesses of all of the layers is defined to be the thickness of the polymer layer of the silver halide photographic material of this invention.

There is no particular restriction on the method of forming the polymer layer in this invention.

For example, after coating the back layer and drying it, the polymer may be coated on the back layer followed by drying, or the back layer and the polymer layer may be simultaneously coated and then dried.

Also, the polymer layer may be formed by dissolving the binder thereof in a solvent for the binder and coating as the solvent system.

As the material for the support used in this invention, a polyester is preferably used, and polyethylene terephthalate (hereinafter abbreviated as PET) fabricated into a film form is more preferably used.

In particular, a biaxially stretched and thermally fixed polyethylene terephthalate film is advantageously used for purposes of stability, toughness, etc.

In the present invention, there is no particular restriction on the thickness of the support, but a support having a thickness of from 15 μm to 500 μm, and particularly from about 40 μm to 200 μm is preferred for purposes of easy handling, wide usability, etc.

Also, the support may be transparent, it may contain a dye, a pigment such as titanium dioxide, etc., or it may further contain silicon dioxide, alumina sol, chromates, zirconium salts, etc.

The subbing layer on the support at the silver halide emulsion side is explained below.

As a high molecular weight material which is used for the non-hydrophilic polymer layer (the first subbing layer) on the hydrophobic support in this invention, for example, a copolymer of a dienic monomer is used.

The copolymer of a dienic monomer is a copolymer containing a dienic monomer having from 4 to about 8 carbon atoms, such as butadiene, isoprene, etc., as one component of the copolymer.

As the other copolymerizable component of the copolymer, the monomers described in JP-A-1-186933, from page 3, upper left column, line 18 to page 3, lower left column, line 1 can be used. (The term "JP-A" as used herein means an "unexamined published Japanese patent application".)

Examples of the monomers include acrylates, arylamides, methacrylates, methacrylamides, allyl compounds, vinylethers, vinylesters, vinyl heterocyclic compounds, N-vinyl compounds, styrenes, crotonic acids, itaconic acids, olefins, and maleic anhydrides. Specific examples of these monomers include acrylic acids such as acrylic acid and acrylate (e.g., ethyl acrylate, propyl acrylate, butyl acrylate, amyl acrylate, ethylhexyl acrylate, octyl acrylate, t-octyl acrylate, 2-methoxyethyl acrylate, 2-butoxyethyl acrylate, 2-phenoxyethyl acrylate, chloroethyl acrylate, hydroxyethyl acrylate, cyanoethyl acrylate, hydroxypropyl acrylate, dimethylaminoethyl acrylate, 2,2-dimethylhydroxypropyl acrylate, 5-hydroxypentyl acrylate, diethylene glycol monoacrylate, trimethylolpropane monoacrylate, pentaerythritol monoacrylate, glycidyl acrylate, 2-hydroxy-3-chloropropyl acrylate, benzyl acrylate, methoxybenzyl acrylate, furfuryl acrylate, tetrahydrofurfuryl acrylate, phenyl acrylate), methacrylic acids such as metharylic acid and methacrylate (e.g., methyl methacrylate, ethyl methacrylate, propyl methacrylate, isopropyl methacrylate, amyl methacrylate, hexyl methacrylate, cyclohexyl methacrylate, benzyl methacrylate, cyanoacetoxyethyl methacrylate, chlorobenzyl methacrylate, octyl methacrylate, sulfopropyl methacrylate, N-ethyl-N-phenylaminoethyl methacrylate, ethylene glycol monomethacrylate, 2-hydroxyethyl methacrylate, 3-hydroxypropyl methacrylate, 2-hydroxypropyl methacrylate, 4-hydroxybutyl methacrylate, 5-hydroxypentyl methacrylate, 2,2-dimethyl-3-hydroxypropyl methacrylate, diethylene glycol monomethacrylate, trimethylolpropane monomethacrylate, pentaerythritol monomethacrylate, glycidyl methacrylate, 2-methoxyethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate); acrylamides such as acrylamide and N-substituted acrylamide (e.g., methyl acrylamide, ethyl acrylamide, propyl acrylamide, isopropyl acrylamide, butyl acrylamide, t-butyl acrylamide, heptyl acrylamide, t-octyl acrylamide, cyclohexyl acrylamide, benzyl acrylamide, hydroxymethyl acrylamide, methoxyethyl acrylamide, dimethylaminoethyl acrylamide, hydroxyethyl acrylamide, phenyl acrylamide, hydroxyphenyl acrylamide, triacrylamide, naphthyl acrylamide, dimethyl acrylamide, diethyl acrylamide, dibutyl acrylamide, diisobutyl acrylamide, diacetone acrylamide, methylbenzyl acrylamide, benzyloxyethyl acrylamide, β-cyanoethyl acrylamide, acryloyl morpholine, N-methyl-N-acryloyl piperadine, N-acryloyl piperidine, acryloyl glycine, N-(1,1-dimethyl-3-hydroxybutyl)acrylamide, N-β-morpholinoethyl acrylamide, N-acryloylhexamethyleneimine, N-hydroxyethyl-N-methyl acrylamide, N-2-acetamidoethyl-N-acetyl acrylamide), methacrylamides such as methacrylamide and N-substituted methacrylamide (e.g., methyl methacrylamide, t-butyl methacrylamide, t-octyl methacrylamide, benzyl methacrylamide, cyclohexyl methacrylamide, phenyl methacrylamide, dimethyl methacrylamide, diethyl methacrylamide, dipropyl methacrylamide, hydroxyethyl-N-methyl methacrylamide, N-methyl-N-phenyl methacrylamide, N-ethyl-N-phenyl methacrylamide), allyl compounds such as allyl ester (e.g., allyl acetate, allyl caproate, allyl caprylate, allyl laurate, allyl palmitate, allyl stearate, allyl benzoate, allyl acetoacetate, allyl lactate), allyl ethyl ethanol, allyl butyl ether, allyl glycidyl ether and allyl phenyl ether, vinyl ethers (e.g., methyl vinyl ether, butyl vinyl ether, hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropylvinyl ether, 2-ethylbutyl ether, hydroxyethylvinyl ether, diethylene glycol vinyl ether, dimethylaminoethyl vinyl ether, diethylaminoethyl vinyl ether, butylaminoethyl vinyl ether, benzyl vinyl ether, tetrahydrofurfuryl vinyl ether, vinyl phenyl ether, vinyl tolyl ether, vinyl chlorophenyl ether, vinyl-2,4-dichlorophenyl ether, vinyl naphthyl ether, vinyl anthranyl ether), vinyl esters such as vinyl acetate, vinyl propionate, vinyl butyrate, vinyl isobutyrate, vinyl dimethyl propionate, vinyl ethyl butyrate, vinyl valerate, vinyl caproate, vinyl chloroacetate, vinyl dichloroacetate, vinyl methoxy acetate, vinyl butoxy acetate, vinyl phenyl acetate, vinyl acetoacetate, vinyl lactate, vinyl-β-phenyl butyrate, vinyl cyclohexyl carboxylate, vinyl benzoate, vinyl salicylate, vinyl chlorobenzoate, vinyl tetrachlorobenzoate, vinyl naphthoate), vinyl heterocyclic compounds such as N-vinyloxazolidone, vinyl pyridine, vinyl picoline, N-vinylimidazole, N-vinylpyrrolidone, N-vinylcarbazole, vinyl thiophene and N-vinyl ethyl acetamide, styrenes (e.g., styrene, methylstyrene, dimethylstyrene, trimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, methoxystyrene, 4-methoxy-3-methylstyrene, dimethoxystyrene, chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethylstyrene, vinyl benzoate, methyl vinyl benzoate), crotonic acids such as crotonic acid, amide crotonate and crotonate (e.g., butyl crotonate, hexyl crotonate, glycerin monocrotonate), vinyl ketones (e.g., methyl vinyl ketone, phenyl vinyl ketone, methoxyethyl vinyl ketone), olefins (e.g., dicyclopentadiene, ethylene, propylene, 1-butene, 1-pentene, 1-hexene, 4-methyl-1-pentene, 1-heptene, 1-octene, 1-decene, 5-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,6,6-trimethyl-1-heptene, 1-dodecene, 1-octadecene), itaconic acids (e.g., itaconic acid, itaconate anhydride, methyl itaconate, ethyl itaconate), crotonic acids (e.g., crotonic acid, methyl crotonate, ethyl crotonate), sorbic acid, cinnamic acid, methyl sorbate, glycidyl sorbate, citraconic acid, chloroacrylic acid, mesaconic acid, maleic acid, fumaric acid, ethacrylic acid, halogenated olefins (e.g., vinyl chloride, vinylidene chloride, isoprene), and unsaturated nitriles (e.g., acrylonitrile, methacrylonitrile). The polymer may be a copolymer made of two or more monomers. Examples of such a copolymer include styrene/n-butyl acrylate/acrylic acid copolymer, and styrene/n-butyl acrylate/glycydyl acrylate copolymer.

These copolymers can be conveniently produced by an emulsion polymerization method and also are commercially available. Also, the content of the diene component in the copolymer is from about 30 to 60% by weight, and preferably from 32 to 40% by weight.

Also, the copolymer may contain a monomer having a hydrophilic moiety, such as an amide, hydroxy, carboxy, etc., in an amount of from about 0.1 to 20% by weight.

As other high molecular weight materials which can be used for the first subbing layer in this invention, copolymers or homopolymers each having a glass transition point of from −20° C. to 40° C. can be used.

Examples of monomers which can be used for the syntheses of such copolymers or homopolymers are described in JP-A-1-186933, from page 3, lower left column, line 13 to page 5, lower right column, line 14.

In the present invention, a styrene-butadiene copolymer and a vinylidene chloride copolymer are preferably used.

As the styrene-butadiene copolymer, a copolymer of styrene and butadiene of from 9/1 to 1/9 by weight ratio may be used, and also the copolymer may further contain acrylic acid, etc., as a third comonomer.

Usually, an aqueous dispersion of the polymer or the copolymer is coated on the support as the subbing layer, and for coating the aqueous dispersion, the aqueous dispersion may be further diluted with water or, if necessary, may contain a crosslinking agent, a surface active agent, a swelling agent, a hydrophilic polymer, a matting agent, an antistatic agent, an electrolyte, etc.

As the crosslinking agent, the compounds described in JP-A-1-186933, page 6, upper left column, from line 7 to line 20 can be used, and also, 2,4-dichloro-6-hydroxy-s-triazine sodium salt is preferably used.

It is not always necessary to add a swelling agent, but, if necessary, phenol, resorcin, etc., may be added to the aqueous dispersion as a swelling agent, and the addition amount thereof is from 1 to 10 g per liter of the coating composition for the subbing layer.

As the hydrophilic polymer, natural polymers such as gelatin, etc.; or synthetic polymers such as polyvinyl alcohol, a vinyl acetate-maleic anhydride copolymer, an acrylic acid-acrylamide copolymer, a styrene-maleic anhydride copolymer, etc., can be used.

As the antistatic agent, anionic or cationic surface active agents, ionene series polymers, the maleic acid copolymers described in JP-A-49-3972, colloidal silica (e.g., Snow Tex, trade name, made by Nissan Chemical Industries, Ltd.), etc., can be used.

Examples of the electrolyte being used for the subbing layer are HCl, HBr, $HClO_4$, LiCl, LiBr, LiI, $LiClO_4$, NaCl, NaBr, NaI, $NaClO_4$, $NaNO_3$, NaOH, KCl, KBr, KI, $KNO_3$, $NH_4Cl$, RbCl, RbBr, RbI, $MgCl_2$, $MgBr_2$, $MgI_2$, $CaCl_2$, $CaBr_2$, $CaI_2$, $Ca(ClO_4)_2$, $SrCl_2$, $Sr(ClO_4)_2$, $BaCl_2$, $BaBr_2$, $BaI_2$, $AlCl_3$, $LaCl_3$, and $Zn(ClO_4)_2$.

These electrolytes can show an antistatic effect, and the addition amount thereof is from 0.001 mg to 100 mg, and preferably from 0.1 mg to 10 mg per square mater.

In this invention, a hydrophilic colloid layer containing a dye dispersed therein in a solid state (the second subbing layer) is formed o the foregoing first subbing layer.

The first subbing layer and the second subbing layer can be formed by a generally well-known coating method for a coating composition for subbing layers, such as, for example, a dip coating method, an air knife coating method, a curtain coating method, a roller coating method, a wire bar coating method, a gravure coating method, and the extrusion coating method using the hopper described in U.S. Pat. No. 2,681,294. If necessary, two or more layers can be simultaneously coated by the methods described in U.S. Pat. Nos. 2,761,791, 3,508,947, 2,941,898, and 3,526,528 and Hitoshi Ozaki, *Coating Koogaku (Engineering)*, page 253, published by Asakura Shoten, 1973.

The coating amount of the copolymer for the first subbing layer in this invention is preferably from 0.01 to 10 g, and particularly from 0.2 g to 3 g as solid component per square meter of the plastic support.

As the hydrophilic colloid containing a dye being used for the second subbing layer in this invention, there are synthetic or nature hydrophilic high molecular weight compounds such as gelatin, acylated gelatin (e.g., phthalated gelatin and maleated gelatin), cellulose derivatives (e.g., carboxy methyl cellulose and hydroxyethyl cellulose), grafted gelatins obtained by grafting acrylic acid, methacrylic acid, or an amide to gelatin, polyvinyl alcohol, polyhydroxyalkyl acrylate, polyvinyl pyrrolidone, copoly-vinyl pyrrolidonevinyl acetate, casein, agarose, albumin, sodium alginate, polysaccharide, agar agar, starch, graft starch, polyacrylamide, polyethyleneimine acrylate, homopolymers or copolymers of acrylic acid, methacrylic acid, acrylamide, N-substituted acrylamide, N-substituted acrylamide, and the partially hydrolyzed products thereof. They may be used singly or as a mixture thereof.

The coating amount of the hydrophilic colloid containing the dye is preferably from 1 to 500 mg/m$^2$, more preferably from 10 to 400 mg/m$^2$, and particularly preferably from 10 to 300 mg/m$^2$.

In the present invention, it is preferred to use a dye dispersed in the form of solid fine particles which are not substantially dissolved in water at a pH of lower than 6 and are substantially soluble in an aqueous solution having pH of at least 8.

The dispersion of a dye in the form of solid fine particles can be carried out according to the methods described in WO 88/04794 and EP-A-0276566.

The particle sizes of the fine crystals of the dye for use in this invention are preferably not larger than 1.0 μm, and more preferably not larger than 0.5 μm.

The amount of the dye used is preferably from 5 $mg/m^2$ to 300 $mg/m^2$, and particularly from 10 $mg/m^2$ to 150 $mg/m^2$.

The dye being used in the present invention can be easily synthesized by the methods described in WO 88/04794, EP-A-274723, EP-A-276566, and EP-A-299435, JP-A-52-92716, JP-A-55-155350, JP-A-55-155351, JP-A-61 -205934, JP-A-48-68623, U.S Pat. Nos. 2,527,583, 3,486,897, 3,746,539, 3,933,798, 4,130,429, and 4,040,841, JP-A-1-50874, JP-A-2-282244, and JP-A-1-307363, and by similar methods to the foregoing methods.

Specific examples of the dyes which are preferably used in the presented invention are illustrated below, but the invention is not limited to them.

AH-1

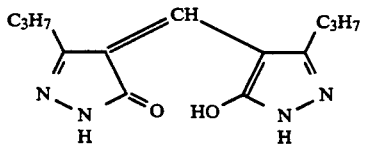

AH-2

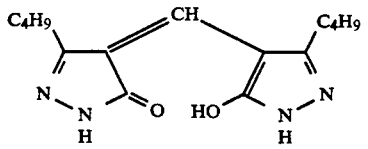

AH-3

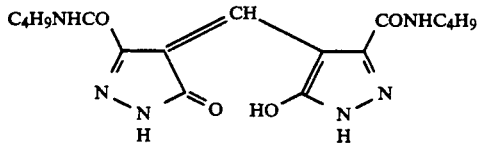

AH-4

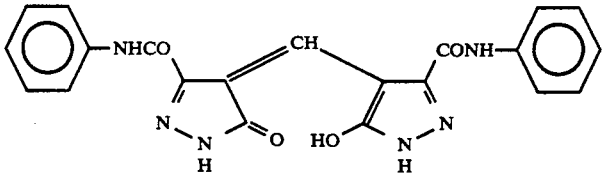

AH-5

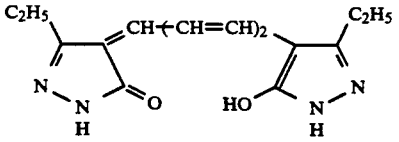

AH-6

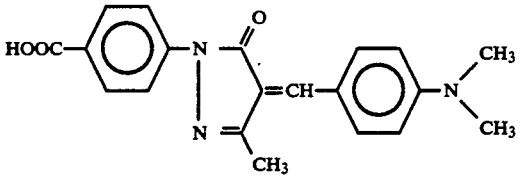

AH-7

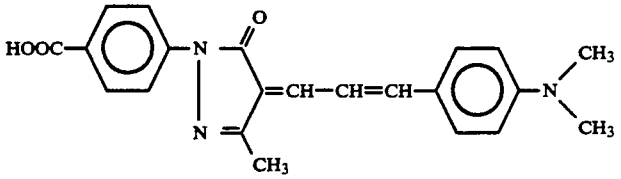

-continued
AH-8
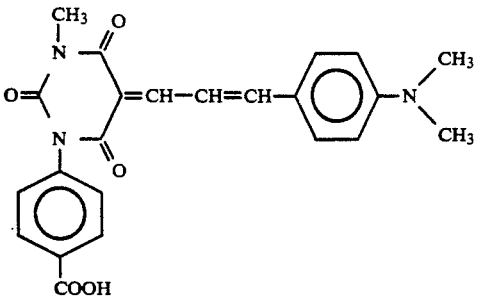
AH-9
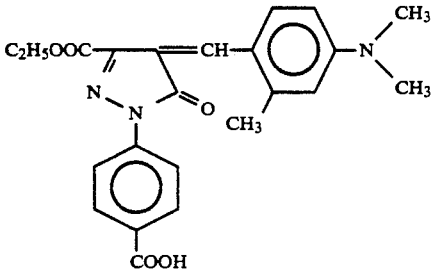
AH-10
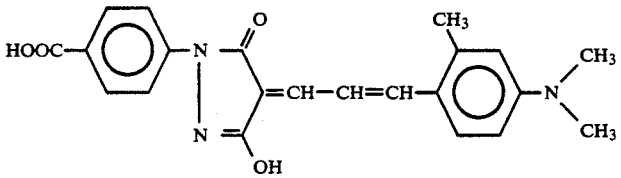
AH-11
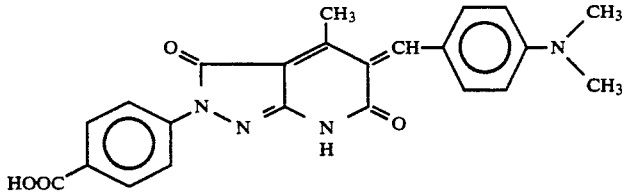
AH-12
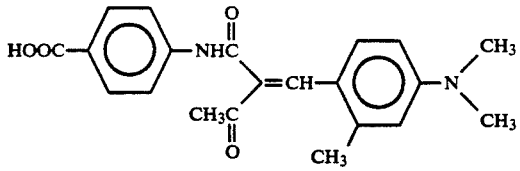
AH-13
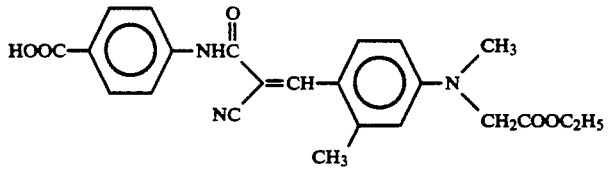
AH-14
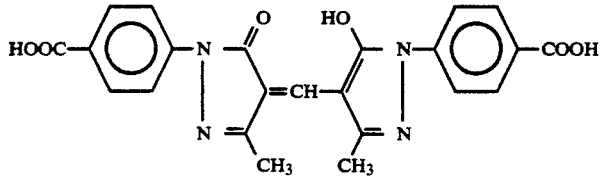

-continued
AH-15
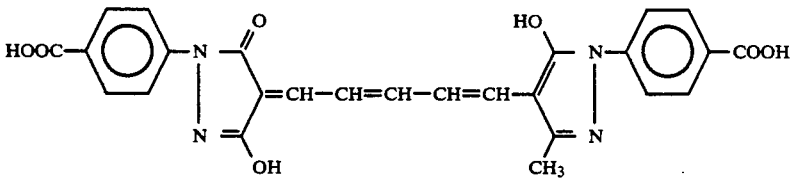
AH-16
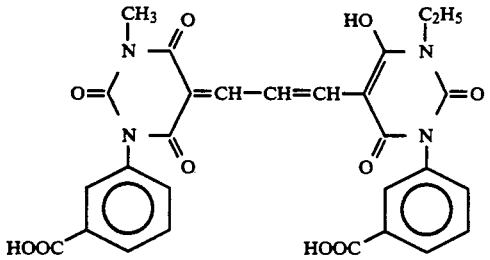
AH-17
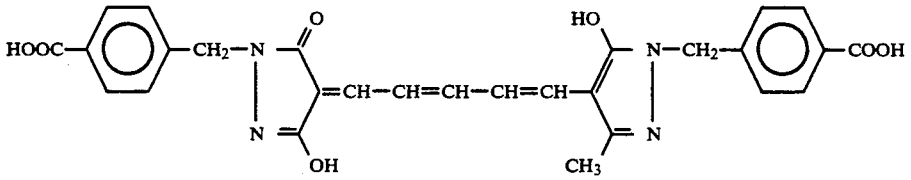
AH-18
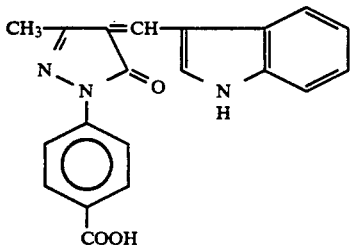
AH-19
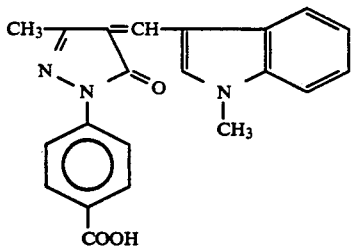
AH-20
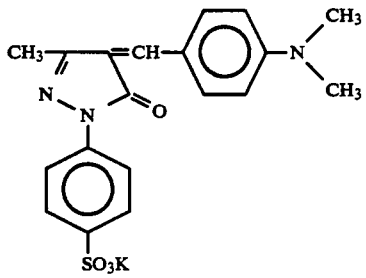

-continued

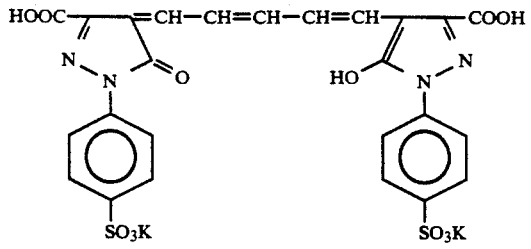

AH-21

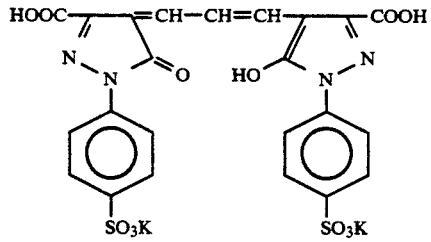

AH-22

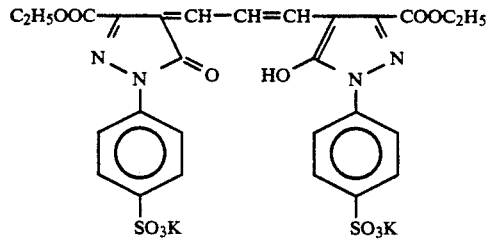

AH-23

It is preferred that the hydrophilic colloid layer in this invention contains a latex, and the glass transition temperature of the latex is preferably 30° C. or lower, and more preferably 20° C. or lower.

Practical examples of the latex being used in this invention are polyvinyl acetate, polybutyl methacrylate, polymethyl acrylate, polyethyl acrylate, polybutyl acrylate, polybutadiene, and polyethylene. Also, a methyl methacrylate-ethyl acrylate copolymer, a vinyl acetate-ethylene copolymer, etc., can be used, but the invention is not limited to these compounds.

The coating amount of the latex is preferably from 5 $mg/m^2$ to 250 $mg/m^2$, and particularly from 5 $mg/m^2$ to 100 $mg/m^2$.

It is preferred that the ratio of gelatin to the latex is in the range of from 1/1 to 10/1.

When silver halide photographic emulsion layer(s) are coated on the subbing layer in this invention, if the coating amount of the total hydrophilic colloids is large, the amount of water contained in the layers in the photographic processing steps is increased to give an undesirable load to a drying step. Accordingly, the coating amount of the total hydrophilic colloids is preferably not more than 3 $g/m^2$, and more preferably not more than 2.8 $g/m^2$ per one surface of the support.

As the silver halide for the light-sensitive silver halide emulsion being used in this invention, silver chlorobromide, silver bromide, silver iodobromide, silver chloroiodobromide, etc., can be used, but silver iodobromide is preferably used. In this case, it is preferred that the content of silver iodide is in the range of not more than 30 mol %, and particularly not more than 10 mol %. The distribution of iodine in the silver iodobromide grains may be uniform or may differ between the inside and the surface portion of the grain. The mean grain size thereof is preferably not smaller than 0.4 μm, and particularly preferably is from 0.5 μm to 2.0 μm. The grain size distribution may be narrow or broad.

The silver halide grains in the silver halide emulsion may have a regular crystal form such as cubic, octahedral, tetradecahedral, rhombic dodecahedral, etc., or an irregular crystal form such as spherical, tabular, pebble like form, etc., or may have a composite form of these crystal forms. Also, the silver halide grains may be composed of a mixture of grains having various crystal forms.

Tabular silver halide grains having a mean aspect ratio of at least 5/1 have a larger covering power than regular silver halide grains and hence are preferable for decreasing the coating amount of silver. In the present invention, it is preferred that tabular silver halide grains having an average aspect ratio of greater than 5/1 account for at least 50 percent of the total projected area of the whole silver halide grains contained in the silver halide emulsion layer, and it is more preferred that the foregoing tabular silver halide grains account for from 70 percent to 100 percent of the total projected area. (Details of these tabular silver halide grains are described in *Research Disclosure*, Vol. 225, Item 22534, pages 20 to 58 (January, 1983), JP-A-58-127921 and JP-A-58-113926.)

In the present invention, the light-sensitive silver halide emulsion may be composed of a mixture of two or more kinds of silver halide emulsions. The grain sizes, the halogen composition, the sensitivity, etc., of each of the silver halide emulsions being mixed may differ from each other. A substantially light-insensitive silver halide emulsion (the surface or the inside thereof may be or may not be fogged) may be used as a mixture with a light-sensitive silver halide emulsion or may be used as a separate layer from a light-sensitive silver halide emulsion layer (as described in detail in U.S. Pat.

Nos. 2,996,382 and 3,397,987). For example, a spherical or pebble like grain light-sensitive emulsion may be used in a same layer as a light-sensitive silver halide emulsion layer containing tabular silver halide grains having an aspect ratio of at least 5 or may be used as a layer different from the layer of the latter light-sensitive silver halide emulsion as described in JP-A-58-127921. In the case of using these silver halide emulsions as different layers, the layer of the tabular grain silver halide emulsion may be disposed at the side nearer to the support or at the side farther from the support.

The silver halide photographic emulsions for use in this invention can be prepared using the methods described in P. Glafkides, *Chimie et Phisique Photographique,* published by Paul Montel, 1967, V. L. Zelikman et al, *Making and Coating Photographic Emulsion,* published by The Focal Press Co., 1964, G. F. Duffin, *Photographic Emulsion Chemistry,* published by The Focal Press Co., 1966, JP-A-58-127921, and JP-A-58-113926.

That is, an acid method, a neutralization method, an ammonia method, etc., may be used, and also as a method of reacting a soluble silver salt and a soluble halide, a single jet method, a double jet method, or a combination thereof be used.

A so-called reverse mixing method, i.e., a method of forming silver halide grains in the presence of excessive silver ions can be used. As one of the double jet methods, a so-called controlled double jet method of keeping constant pAg in the liquid phase for forming the silver halide grains can be used. According to this method, a silver halide emulsion composed of silver halide grains having a regular crystal form and an almost uniform grain size is obtained.

The crystal structure of the silver halide grains for use in this invention may be uniform throughout the whole grain, may have a layer structure having different quality between the inside and the surface portion thereof, or may be of a so-called conversion type as described in British Patent 635,841 and U.S. Pat. No. 3,622,318.

In the step of forming or physical-ripening the silver halide grains at the production of the silver halide emulsion, a cadmium salt, a zinc salt, a lead salt, a thallium salt, an iridium salt or the complex salt thereof, a rhodium salt or the complex salt thereof, or an iron salt or the complex salt thereof may coexist.

Also, at the formation of the silver halide grains, a so-called silver halide solvent such as ammonia, a thioether compound, thiazolidine-2-thione, tetra-substituted thiourea, potassium thiocyanate, ammonium thiocyanate, an amine compound, etc., may exist in the system for controlling the growth of the grains.

The silver halide emulsion for use in this invention may be or may not be chemically sensitized. As the chemical sensitizing method, a sulfur sensitizing method, a selenium sensitizing method, a reduction sensitizing method, a noble metal sensitizing method, etc., can be used singly or as a combination thereof.

A gold sensitizing method is a typical method of the noble metal sensitizing methods, and as a gold compound, a gold complex salt is mainly used. In this case, the sensitizing system may further contain a noble metal other than gold, such as the complex salt of platinum, palladium, iridium, etc. Details of the sensitizing method are described in U.S. Pat. No. 2,448,060 and British Patent 618,061.

As the sulfur sensitizer, sulfur compounds contained in gelatin or other various sulfur compounds such as thiosulfates, thiourea, thiazoles, rhodanines, etc., can be used.

As the reduction sensitizer, stannous salts, amines, formamidinesulfinic acid, silane compounds, etc., can be used.

The silver halide emulsions for use in this invention can contain various compounds for the purposes of inhibiting the occurrence of fog during the production, storage, or photographic processing of the silver halide photographic material and stabilizing the photographic performance.

The compounds being used for these purposes are described in JP-A-2-264936, page 10, lower right column, line 7 to page 11, upper left column, line 17.

The surface active agents being used for these purposes are described in JP-A-2-264936, page 11, upper right column, line 4 to page 11, lower right column, line 2.

The antistatic agents being used in this invention are described in JP-A-2-264936, page 11, lower right column, line 3 to line 19.

In the present invention, a matting agent can be used, and as the matting agent, fine particles of an organic compound such as polymethyl methacrylate, a copolymer of methyl methacrylate and methacrylic acid, starch, etc., or an inorganic compound such as silica, titanium dioxide, etc., can be used. The particle sizes of the matting agent are preferably from 1.0 μm to 10 μm, and particularly preferably from 2 μm to 5 μm.

For the surface layer of the silver halide photographic material of the present invention, the silicone compounds described in U.S. Pat. Nos. 3,489,576 and 4,047,958, colloidal silica described in JP-B-56-23139 (the term "JP-B" as used herein means an "examined published Japanese patent application"), paraffin wax, a higher fatty acid ester, a starch derivative, etc., can be used as a lubricant.

For the hydrophilic colloid-containing silver halide emulsion layer of the silver halide photographic material of the present invention and the surface protective layer formed on the silver halide emulsion layer, polyols such as trimethylpropane, pentanediol, butanediol, ethylene glycol, glycerol, etc., can be used as a plasticizer. Furthermore, it is preferred that the hydrophilic colloid-containing silver halide emulsion layer of the silver halide photographic material of the present invention and the surface protective layer on the silver halide emulsion layer contain a polymer latex for the purpose of improving the pressure resistance. As the polymer for the polymer latex, a homopolymer of an acrylic acid alkyl ester or a copolymer of an acrylic acid alkyl ester and acrylic acid, a styrene-butadiene copolymer, and a polymer or a copolymer composed of a monomer having an active methylene group can be preferably used.

The silver halide photographic emulsion and the light-insensitive hydrophilic colloid being used in this invention may contain an inorganic or organic hardening agent. As the hardening agent, for example, chromium salts, aldehydes (e.g., formaldehyde and glutaraldehyde), N-methylol compounds (e.g., dimethylolurea), active vinyl compounds (e.g., 1,3,5-triacryloyl-hexahydro-s-triazine, bis(vinylsulfonyl)methyl ether, and N,N'-methylenebis-[β-(vinylsulfonyl)propionamide]), active halogen compounds (e.g., 2,4-dichloro-6-hydroxy-s-triazine), mucohalogenic acids (e.g., mucochloric acid), N-carbamoylpyridinium salts (e.g., (1-morpholinocarbonyl-3-pyridinio)methane sulfonate), and haloamidinium salts (e.g., 1-(1-chloro-1-pyridinomethylene)-pyrrolidinium, and 2-naphthalene sulfonate) can be used singly or as a combination thereof. In these compounds, the active vinyl compounds described in JP-B-53-41220, JP-B-53-57257, JP-B-59-162546, and JP-B-60-80846 and the active halides described in U.S. Pat. No. 3,325,287 are preferable.

When the silver halide photographic material of the present invention is used as an X-ray photographic light-sensitive material, it is preferred that the hydrophilic colloid layer is hardened with the foregoing hardening agent such that the swelling ratio of the layer in water is 300% or lower, particularly 250% or lower.

As the binder or the protective colloid which can be used for the silver halide emulsion layers and interlayer of the silver halide photographic material of this invention, gelatin is advantageously used, but other hydrophilic colloids can also be used.

As such hydrophilic colloids, various synthetic hydrophilic high-molecular weight compounds such as dextran, polyvinyl alcohol, polyvinyl alcohol partial acetal, poly-N-vinylpyrrolidone, polyacrylic acid, polyacrylamide, polyvinyl imidazole, and copolymers thereof can be used.

As gelatin, lime-processed gelatin as well as acid-processed gelatin and enzyme-processed gelatin may be used, and also the hydrolyzed products of gelatin can be used.

In the foregoing materials, it is preferred to use dextran and polyacrylamide together with gelatin.

The silver halide photographic material of the present invention is preferably for forming black-and white images, and the silver coverage of the silver halide photographic material of the present invention is preferably not more than 5 $g/m^2$ and more preferably from 1 $g/m^2$ to 3 $g/m^2$.

For photographic processing of the silver halide photographic material of the present invention, known processing processes and known processing solutions for black-and-white processing as described, e.g., in *Research Disclosure,* No. 176, pages 28 to 30 (RD-17643) can be applied. The processing temperature is selected from the range of usually from 18° C. to 50° C., but a temperature lower than 18° C. or a temperature over 50° C. may be used. In this invention, however, processing by an automatic processor at a temperature of from 20° C. to 40° C. is preferred. In this case, the processing time (the time from when the light-sensitive material enters the automatic processor to the time when it emerges therefrom after drying) is preferably from 10 seconds to 3 minutes and 30 seconds, more preferably from 15 seconds to 90 seconds, and particularly preferably from 15 seconds to 45 seconds.

The developer which is used in the case of black-and-white photographic processing can contain a conventional developing agent. That is, as the developing agent, dihydroxybenzenes (e.g., hydroquinone), 3-pyrazolidones (e.g., 1-phenyl-3-pyrazolidone), aminophenols (e.g., N-methylol-p-aminophenol), etc., can be used singly or as a combination thereof.

The developer can further contain generally known additives such as a preservative, an alkali agent, a pH buffer, an antifoggant, etc., and, if necessary, the developer may further contain an auxiliary solvent, a toning agent, a development accelerator (e.g., quaternary salts, hydrazine, and benzyl alcohol), a development inhibitor (e.g., iodides, bromides, mercapto compounds, and triazoles), a surface active agent, a defoaming agent, a water softener, a hardening agent (e.g., glutaraldehyde), a tackifier, etc.

As a specific system of the development process, a system of incorporating a developing agent in the photographic light-sensitive material, e.g., the silver halide emulsion thereof, and processing the light-sensitive material in an aqueous alkali solution to carry out the development may be used. For the developing agent, a hydrophobic developing agent can be incorporated in the silver halide emulsion layer by the various methods described in *Research Disclosure,* No. 169 (RD-16928), U.S. Pat. No. 2,739,890, British Patent 813,253, and West German Patent 1,547,763. Such a development process may be combined with a silver salt stabilizing process with a thiocyanate.

As a fix solution, a fixing composition generally used can be used. As the fixing agent, thiosulfates, thiocyanates, and also organic sulfur compounds which are known to have an effect as a fixing agent can be used. The fix solution may contain a water-soluble aluminum salt as a hardening agent.

Also, when a compound releasing an inhibitor at development as described in JP-A-61-230135 and JP-A-63-25653 is also used, the effect of the present invention becomes more remarkable.

The following examples are intended to illustrate the present invention more practically but not to limit it in any way. Unless otherwise indicated, all parts, percents, ratios and the like are by weight.

EXAMPLE 1

Formation of Subbing Coatings-1

A non-hydrophilic polymer layer having the following compositions and coated amounts was coated on both surfaces of a film support by means of a wire bar coater and dried for one minute at 175° C.

| (The First Subbing Layer) | |
|---|---|
| Butadiene-Styrene Copolymer Latex* (butadiene/styrene = 31/69 by weight ratio) | 0.322 $g/m^2$ |
| 2,4-Dichloro-6-hydroxy-s-triazine Sodium Salt | 4.2 $mg/m^2$ |
| Emulsion Dispersing Agent (a): $nC_6H_{13}OOCCH_2$ / $nC_6H_{13}OOCCH—SO_3Na$ | |

*The foregoing latex solution contained emulsion dispersing agent (a) shown below in an amount of 0.4% by weight to the latex solid components.

Then, a hydrophilic colloid layer having the following composition and coating amounts was coated on both surfaces (on each non-hydrophilic polymer layer) by means of a wire bar coater and dried for one minute at 150° C.

| (Hydrophilic Colloid Layer) | |
|---|---|
| Gelatin | 80 $mg/m^2$ |
| Polyethylene Acrylate | 20 $mg/m^2$ |

-continued (Hydrophilic Colloid Layer)

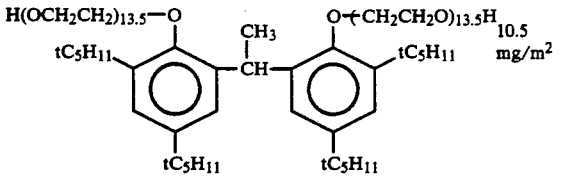

10.5 mg/m²

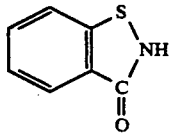

0.27 mg/m²

Formation of Subbing Coatings-2

Back Side Subbing

Same as the case of the subbing coatings-1 described above.

Emulsion Layer Side Subbing

In the case of the non-hydrophilic polymer layer in the subbing coatings-1 described above, the coating amount of 2,4-dichloro-6-hydroxy-s-triazine sodium salt was changed to 14.2 mg/m². Then, a hydrophilic colloid layer having the following composition (including particles of the dyes shown below) and coating amounts was coated on the non-hydrophilic polymer layer by means of a wire bar coater and dried for one minute at 150° C.

| (Hydrophilic Colloid Layer: The 2nd subbing layer) | |
|---|---|
| Gelatin | 300 mg/m² |
| Polyethyl Acrylate | 75 mg/m² |
| Dyes (particles) | 120 mg/m² |

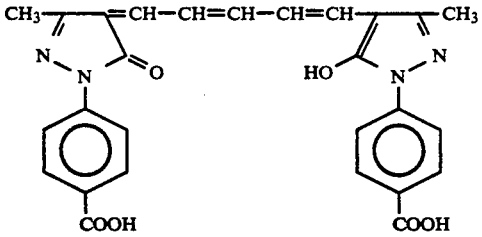

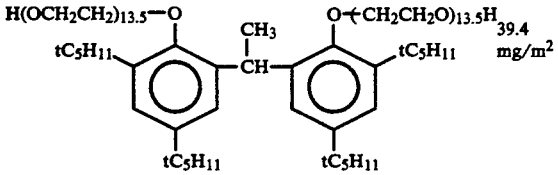

39.4 mg/m²

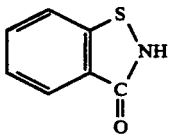

1.01 mg/m²

Preparation of Dye Particles

A mixture of 20 g of the dyes shown above with 200 g of an aqueous solution of 1% carboxymethyl cellulose and 287 g of water was treated in an Eiger mill (manufactured by Eiger Japan K.K.) using zirconium oxide ($ZrO_2$) beads having a diameter of 2 mm for 8 hours at 5,000 r.p.m., and then the $ZrO_2$ beads were filtered away from the mixture obtained to provide the dye particles, which were used in the foregoing hydrophilic colloid layer.

Formation of Subbing Coatings-3

In place of the non-hydrophilic polymer layer of the subbing layer on the emulsion layer side in the subbing coatings-2, a non-hydrophilic polymer layer having the following composition and coating amounts was coated. Other subbing layers were formed in the same manner as in the subbing coatings-2 described above.

| (The 1st Subbing Layer: Non-hydrophilic polymer layer) | |
|---|---|
| Vinylidene Chloride Latex (vinylidene chloride/methacrylic acid/methyl acrylate/methyl methacrylate/acrylonitrile = 90/0.3/4/4/1.7 by weight ratio) | 0.9 g/m² |
| 2,4-Dichloro-6-hydroxy-s-triazine Sodium Salt | 4.4 mg/m² |

Formation of Subbing coatings-4

In place of the non-hydrophilic polymer layer of the subbing layer on the emulsion layer side in the formation of the subbing coatings-2, a non-hydrophilic polymer layer having the following composition and coating amounts was coated. Other subbing layers were formed in the same manner as in the case of the subbing coatings-2.

| (The 1st Subbing Layer: Non-hydrophilic polymer layer) | |
|---|---|
| Aqueous Polyester WD-SIZE (trade name, made by Eastman Kodak Co.) | 0.16 mg/m² |
| 2,4-Dichloro-6-hydroxy-s-triazine Sodium Salt | 3.8 mg/m² |
| Sodium Diisooctylsulfosuccinate | 0.04 mg/m² |

Formation of Subbing Coatings-5

In place of the non-hydrophilic polymer layer of the subbing layer on the emulsion layer side in the formation of the subbing coatings-2, a non-hydrophilic polymer layer having the following composition and coating amounts was coated. Other subbing layers were formed in the same manner as in the subbing coatings-2.

| (The 1st Subbing Layer: Non-hydrophilic polymer layer) | |
|---|---|
| Polyacrylic Acid Ester: Jurymer ET 410 (trade name, made by Nippon Junyaku K.K.) | 0.16 mg/m² |
| 2,4-Dichloro-6-hydroxy-s-triazine Sodium Salt | 6.5 mg/m² |

Preparation of Photographic Light-Sensitive Material Sample 2

On the back side of the subbing coatings-1 were coated back layers each having the following composition and coating amounts, and the coated supports dried for 5 minutes at 50° C.

| [Back Layers] | |
|---|---|
| (1) Light-Insensitive Hydrophilic Colloid Layer | |
| Gelatin | 3.0 g/m$^2$ |
| Polymethyl Methacrylate Fine Particles (mean particle size: 3 μm) | 50 mg/m$^2$ |
| Sodium Dodecylbenzenesulfonate | 10 mg/m$^2$ |
| Sodium Polystyrenesulfonate | 20 mg/m$^2$ |
| N,N'-Ethylenebis(vinylsulfonacetamide) | 30 mg/m$^2$ |
| Ethyl Acrylate Latex (mean particle size 0.1 μm) | 1.0 g/m$^2$ |
| (2) Hydrophobic Polymer Layer | |
| Binder (B-1) | (shown in Table 1) |
| Polymethyl Methacrylate Fine Particles (mean particle size: 3 μm) | 10 mg/m$^2$ |
| $C_8F_{17}SO_3K$ | 5 mg/m$^2$ |

In addition, as the solvent for the coating compositions for forming the above layers, distilled water was used.

Furthermore, the binders shown in Table 1 below are as follows:

B-1: Latex of methyl methacrylate/acrylic acid=97/3

B-2: Latex of butyl methacrylate/methacrylic acid=97/3

B-3: Latex of styrene/butadiene/divinylbenzene/methacrylic acid=20/72/6/2

B-4: Latex of vinyl acetate/ethylene/acrylic acid=78/20/2

B-5: Latex of vinylidene chloride/acrylonitrile/methyl methacrylate/ethyl methacrylate/acrylic acid=90/1/4/4/1.

Preparation of Coating Composition for Silver Halide Emulsion

The coating compositions for the silver halide emulsion as in Example 3 of JP-A-3-210554 was prepared. That is, the silver halide emulsion was prepared in the following manner.

| Solution I (75° C.) | |
|---|---|
| Inert Gelatin | 24 g |
| Distilled Water | 900 ml |
| KBr | 4 g |
| 10% Aqueous Solution of Phosphoric Acid | 2 ml |
| Sodium Benzenesulfinate | $5 \times 10^{-2}$ mol |
| 2-Mercapto-3,4-methylthiazole | $2.5 \times 10^{-3}$ g |
| Solution II (35° C.) | |
| Silver Nitrate | 170 g |
| Distilled Water to make | 1,000 ml |
| Solution III (35° C.) | |
| KBr | 230 g |
| Distilled Water to make | 1,000 ml |
| Solution IV (room temperature) | |
| Potassium Hexacyanoferrate(II) | 3.0 mg |
| Distilled Water to make | 100 ml |

The solution II and the solution III were simultaneously added to the well stirred solution I over a period of 45 minutes. When the addition of the total amount of the solution II was completed, a cubic monodisperse emulsion having an average particle diameter of 0.28 μm was finally obtained. In the addition of the solutions II and III, the solution III was added at such a rate that the pAg value in the mixing container was kept at 7.50. After 7 minutes from the commencement of the addition of the solution II, the solution IV was added over a period of 5 minutes. After the completion of the addition of the solution II, washing with water was conducted, desalting was conducted by a precipitation method and the resulting product was dispersed in an aqueous solution containing 100 g of inert gelatin. To the resulting emulsion, there were added 34 mg of sodium thiosulfate and 34 mg of chloroauric acid, each amount being per mol of silver. The pH was adjusted to 8.9 and the pAg value was adjusted to 7.0 (40° C.) The emulsion was then chemically sensitized at 75° C. for 60 minutes to obtain a surface latent image type silver halide emulsion.

Silver Halide Emulsion Layer and Protective Layer

The silver halide emulsion layer and the protective layer as in Example 3 of JP-A-3-210554 were formed. The coating weights of the silver halide emulsion layer and the protective layer were as follows.

Silver Halide Emulsion Layer

| | |
|---|---|
| Silver Halide Emulsion (in terms of silver) | 1,700 mg/m$^2$ |
| Sensitizing Dye | 238 mg/m$^2$ |

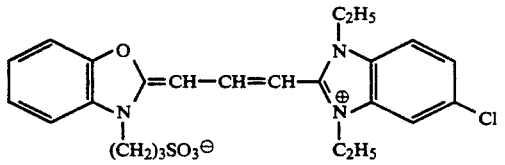

| | |
|---|---|
| 5-Methylbenzotriazole | 4.1 |
| Sodium Dodecylbenzenesulfonate | 5 |
| 1,3-Divinylsulfonyl-2-propanol | 56 |
| Polysodium Styrenesulfonate | 35 |
| Protective Layer | |
| Inert Gelatin | 1,300 mg/m$^2$ |
| Colloidal Silica | 249 |
| Liquid Paraffin | 60 |
| Strontium Barium Sulfate (average particle size: 1.5 μm) | 32 |
| Proxel | 4.3 |
| Sodium Dodecylbenzenesulfonate | 4.0 |
| Potassium Salt of N-Perfluorooctanesulfonyl-N-propylglycine | 5.0 |
| 1,3-Bis(vinylsulfonyl)-2-propanol | 56 |

Preparation of Photographic Light-Sensitive Material Sample 5

The photographic light-sensitive material sample was prepared in the same manner as the photographic light-sensitive material sample 2 except that the subbing coatings-2 were used in place of the subbing coatings-1.

Preparation of Photographic Light-Sensitive Material Sample 6, 7, 8 or 9

The photographic light-sensitive material sample was prepared in the same manner as the photographic light-sensitive material sample 5 except for replacing the binder and coated amount thereof as shown in Table 1.

Preparation of Photographic Light-Sensitive Material Sample 4

The photographic light-sensitive material sample was prepared in the same manner as the photographic light-sensitive material sample 5 except that the back layers were not formed.

Preparation of Photographic Light-Sensitive Material Sample 3

The photographic light-sensitive material sample was prepared by forming an antihalation layer having the following composition and coating amounts between the subbing coatings-1 and the silver halide emulsion layer in the case of preparing the photographic light-sensitive material sample 2 simultaneously with the silver halide emulsion layer at a gelatin coverage of 1.64 g/m$^2$.

| (Antihalation layer) | |
|---|---|
| Gelatin | 100 g |
| Dye | 7.3 g |
| 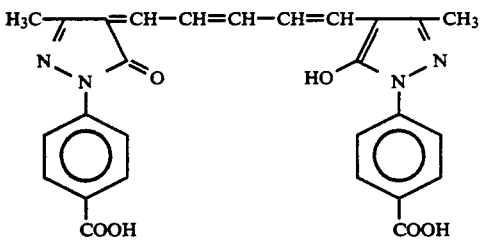 | |
| 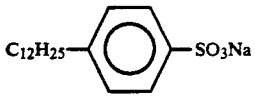 | 0.8 g |
| N,N'-Ethylenebis(vinylsulfonacetamide) | 4 g |

Furthermore, the following samples were prepared.

Preparation of Photographic Light-Sensitive Material Sample 1

The photographic light-sensitive material sample was prepared in the same manner as the photographic light-sensitive material sample 3 except that the back layers were not formed.

Preparation of Photographic Light-Sensitive Material Sample 10

The photographic light-sensitive material sample was prepared in the same manner as the photographic light-sensitive material sample 2 except that the subbing coatings-3 were used in place of the subbing coatings-1.

Preparation of Photographic Light-Sensitive Material Sample 11

The photographic light-sensitive material sample was prepared in the same manner as the photographic light-sensitive material sample 2 except that the subbing coatings-4 were used in place of the subbing coatings-1.

Preparation of Photographic Light-Sensitive Material Sample 12

The photographic light-sensitive material sample was prepared in the same manner as the photographic light-sensitive material sample 2 except that the subbing coatings-5 were used in place of the subbing coatings-1.

Exposure and Processing of Coated Samples (a) Exposure

Light exposure was applied onto the emulsion-coated surface of each sample for $10^{-3}$ second through a continuous density wedge using a xenon flash sensitometer, MARK-II (trade name, made by E.G. & G. Co. in the U.S.A.) under a safelight.

(b) Photographic Processing

Negative photographic processing of each sample thus exposed was carried out with a deep tank type automatic processor, F-10 (trade name, made by Allen Products Co. in the U.S.A.), using a commercially available microfilm processing solutions, i.e., a developer, FR-537 and a fix solution, FR-535 (trade names, made by FR Chemicals Co. in the U.S.A.), according to the following conditions.

| Step | Processing Solution | Temperature | Time |
|---|---|---|---|
| 1. Development | FR-537 (Chemicals:water = 1:3) | 43° C. | 15 sec. |
| 2. Wash | Running water | " | " |
| 3. Fix | FR-535 (Chemicals:water = 1:3) | " | " |
| 4. Wash | Spray | " | " |
| 5. Drying | Hot blast | 50° C. | " |

Evaluation of Drying Property

A sample of 35 mm×120 mm was processed by the foregoing automatic processor under an atmosphere of 25° C., 60% RH. In this case, the line speed of the automatic processor was changed, and the processing time was increased from 20 seconds (i.e., the time for each of the five steps is 4 seconds) with a time interval of 5 seconds (i.e., the time interval for each step is 1 second).

The dried extents of the samples directly after processing are classified into the following three levels, wherein the allowable level for practical use is level ○.

In Table 1, the processing times which are shown are the shortest processing times needed to achieve level ○.

○: Completely dried. Film is warm.

Δ: Slightly wetted. The film temperature is about room temperature.

X: Wetted. Films adhered to each other.

Evaluation of Curing

Each sample was sliced to 5 cm in length and 1 cm in width and was stored for 3 days under the condition of 25° C., 60% RH. Then, the sample was transferred to be under a condition of 25° C., 10% RH, and then curling after 2 hours was measured.

The curling value was determined by the following formula:

$$\text{Curling value} = 1/(\text{curvature radius (cm) of sample})$$

In this evaluation, the curling value wherein the emulsion layer surface is inside the curvature is defined to be positive and the curling value wherein the emulsion layer surface is outside the curvature is defined to be negative.

The allowable curling value for practical use is in the range of from −0.02 to +0.02.

Evaluation of Sharpness

Each sample was exposed using an MTF chart and processed with the foregoing automatic processor. The sample thus processed was measured with an aperture of 2 μm×400 μm, and the sharpness was evaluated at the portion of the optical density of 1.0 using an MTF value of 20 cycles/mm in space frequency.

Evaluation of Residual Color

Each sample was processed with the foregoing automatic processor wherein the temperature of the wash water after fixing was lowered from 43° C. to 30° C., and then the residual color was visually observed, with each sample being evaluated according to the following.

○: No problem for practical use.

X: Problem for practical use.

The results obtained are shown below in Table 1.

As shown in Table 1, it can be seen that according to the present invention, silver halide photographic materials which are excellent in regard to drying, curling, and sharpness are obtained.

TABLE 1

| Sample | Subbing coatings | AH Layer | Back Layer | Polymer Layer | | (A) (sec.) | (B) | (C) | (D) |
|---|---|---|---|---|---|---|---|---|---|
| 1 (Comparison) | 1 | Formed | None | — | | 80 | 0.10 | 1.01 | X |
| 2 (Comparison) | 1 | None | Formed | B-1 | 1 μm (1 g/m²) | 50 | 0.01 | 0.51 | ○ |
| 3 (Comparison) | 1 | Formed | " | " | 1 μm (1 g/m²) | 80 | 0.05 | 1.02 | X |
| 4 (Comparison) | 2 | None | None | — | | 50 | 0.08 | 1.00 | ○ |
| 5 (Invention) | " | " | Formed | B-1 | 1 μm (1 g/m²) | " | 0.00 | 1.00 | ○ |
| 6 (Invention) | " | " | " | B-2 | 1 μm (1 g/m²) | " | 0.01 | 0.99 | ○ |
| 7 (Invention) | " | " | " | B-3 | 1 μm (1 g/m²) | " | 0.01 | 0.99 | ○ |
| 8 (Invention) | " | " | " | B-4 | 1 μm (1 g/m²) | " | 0.00 | 1.00 | ○ |
| 9 (Invention) | " | " | " | B-5 | 0.5 μm (0.5 g/m²) | " | 0.01 | 1.01 | ○ |
| 10 (Invention) | 3 | " | " | B-1 | 1 μm (1 g/m²) | " | 0.00 | 1.00 | ○ |
| 11 (Invention) | 4 | " | " | " | 1 μm (1 g/m²) | " | 0.01 | 1.02 | X |
| 12 (Invention) | 5 | " | " | " | 1 μm (1 g/m²) | " | 0.01 | 1.01 | X |

(A): Drying Property, (B): Curling, (C): Sharpness, (D): Residual Color

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a support having on one surface thereof (A) a subbing layer composed of (1) at least one non-hydrophilic polymer layer and (2) a hydrophilic colloid layer containing a dye dispersed therein in a solid state, wherein the hydrophilic colloid layer is coated on the non-hydrophilic polymer layer, and (B) at least one silver halide emulsion layer having a hydrophilic colloid as a binder, wherein the at least one silver halide emulsion layer is formed on the subbing layer, and having on the surface of the support opposite to the side having the silver halide emulsion layer (C) a light-insensitive hydrophilic colloid layer having a hydrophilic colloid as a binder, wherein said silver halide photographic material has a hydrophobic polymer layer which is positioned on the side of the support having the light-insensitive hydrophilic colloid layer and which is located further from the support than the light-insensitive hydrophilic colloid layer, and wherein said light-insensitive hydrophilic colloid layer and said hydrophobic polymer layer do not swell substantially when processed with a processing solution.

2. A silver halide photographic element of claim 1, wherein the thickness of said light-insensitive hydrophilic colloid layer is 0.5 μm to 10 μm.

3. A silver halide photographic element of claim 1, wherein the binder of said light-insensitive hydrophilic colloid layer is gelatin.

4. A silver halide photographic element of claim 1, wherein for the non-hydrophilic polymer layer in the subbing layer, a vinylidene chloride latex or a styrene-butadiene copolymer latex is used.

5. A silver halide photographic element of claim 2, wherein for the non-hydrophilic polymer layer in the subbing layer, a vinylidene chloride latex or a styrene-butadiene copolymer latex is used.

6. A silver halide photographic element of claim 3, wherein for the non-hydrophilic polymer layer in the subbing layer, a vinylidene chloride latex or a styrene-butadiene copolymer latex is used.

7. A silver halide photographic element of claim 1, wherein the support is a polyester support.

8. A silver halide photographic element of claim 1, wherein the support is a polyethylene terephthalate support.

9. A silver halide photographic element of claim 1, wherein the light-insensitive hydrophilic colloid layer contains a binder selected from the group consisting of lime-processed gelatin and acid-processed gelatin.

10. A silver halide photographic element of claim 1, wherein the light-insensitive hydrophilic colloid layer has a thickness of from 0.2 μm to 20 μm.

11. A silver halide photographic element of claim 1, wherein the light-insensitive hydrophilic colloid layer has a thickness of from 0.2 μm to 10 μm.

12. A silver halide photographic element of claim 1, wherein the hydrophobic polymer layer has a thickness of from 0.05 μm to 10 μm.

13. A silver halide photographic element of claim 1, wherein the hydrophobic polymer layer has a thickness of from 0.1 μm to 5 μm.

14. A silver halide photographic element of claim 1, wherein the hydrophilic colloid layer containing a dye dispersed therein is coated in an amount of from 1 to 500 $mg/m^2$.

15. A silver halide photographic element of claim 1, wherein the hydrophilic colloid layer containing a dye dispersed therein is coated in an amount of from 10 to 400 $mg/m^2$.

16. A silver halide photographic element of claim 1, wherein the dye in the hydrophilic colloid layer containing a dye dispersed therein is present in an amount of from 5 to 300 $mg/m^2$.

17. A silver halide photographic element of claim 1, wherein the dye in the hydrophilic colloid layer containing a dye dispersed therein is present in an amount of from 10 to 150 $mg/m^2$.

18. A silver halide photographic element of claim 1, wherein the hydrophilic colloid layer containing a dye dispersed therein contains a latex.

19. A silver halide photographic element of claim 18, wherein the latex has a glass transition temperature of at most 30° C.

20. A silver halide photographic element of claim 18, wherein the latex has a glass transition temperature of at most 20° C.

* * * * *